United States Patent [19]

Horman et al.

[11] Patent Number: 4,530,613

[45] Date of Patent: Jul. 23, 1985

[54] DEVICE FOR MONITORING PAPER IN TYPEWRITERS AND SIMILAR MACHINES

[75] Inventors: Richard Horman, Schwabach; Wilfried Rettke, Altdorf, both of Fed. Rep. of Germany

[73] Assignee: Triumph-Adler Aktiengesellschaft fur Buro- und Informationstechnik, Nuremberg, Fed. Rep. of Germany

[21] Appl. No.: 605,149

[22] Filed: Apr. 30, 1984

[30] Foreign Application Priority Data

May 6, 1983 [DE] Fed. Rep. of Germany ..... 3316580

[51] Int. Cl.[3] ..... B41J 11/64

[52] U.S. Cl. ..... 400/708; 400/708.1; 116/234

[58] Field of Search ..... 400/595, 596, 645.1, 400/703, 706, 707, 707.1, 707.5, 708, 635, 708.1; 116/234, 235, 236, 237

[56] References Cited

U.S. PATENT DOCUMENTS

| | | | |
|---|---|---|---|
| 1,841,588 | 1/1932 | Davis | 400/708.1 |
| 2,153,754 | 4/1939 | Heineman et al. | 400/708 |
| 4,014,427 | 3/1977 | Rines | 400/708.1 |
| 4,141,660 | 2/1979 | Bommersheim et al. | 400/708 X |

FOREIGN PATENT DOCUMENTS

| | | | |
|---|---|---|---|
| 2746059 | 4/1979 | Fed. Rep. of Germany | 400/706 |
| 0141651 | 5/1980 | Fed. Rep. of Germany | 400/703 |
| 57-0208289 | 12/1982 | Japan | 400/703 |

OTHER PUBLICATIONS

IBM Tech. Disc. Bulletin, "Paper Out Indicator", Cassell et al., vol. 11, No. 11, Apr. 1969, p. 1482.

*Primary Examiner*—Edgar S. Burr
*Assistant Examiner*—James R. McDaniel
*Attorney, Agent, or Firm*—Joseph R. Spalla

[57] ABSTRACT

A device for monitoring paper feed movement in typewriters, printers or other paper-feeding apparatus, e.g. photocopiers wherein paper sheets inserted between a rotatable platen and pressure rollers are driven incident to rotation of the platen. A signal generator has a driving roll of the same size as the pressure rollers and axially aligned therewith which is prevented from being driven by the platen by the interposition of a narrow stationary belt positioned between the platen and drive roller adjacent one end of the platen. When paper is inserted a side edge passes between the belt and the drive roll and movement of the paper incident to platen rotation drives the drive roll of the pulse generator which monitors paper movement. If there is no paper movement due to paper jams or the end of a paper sheet is reached this condition is detected by the absence of pulses at the output of the pulse generator. The absence of pulse sequences serve to shut down the machine.

5 Claims, 1 Drawing Figure

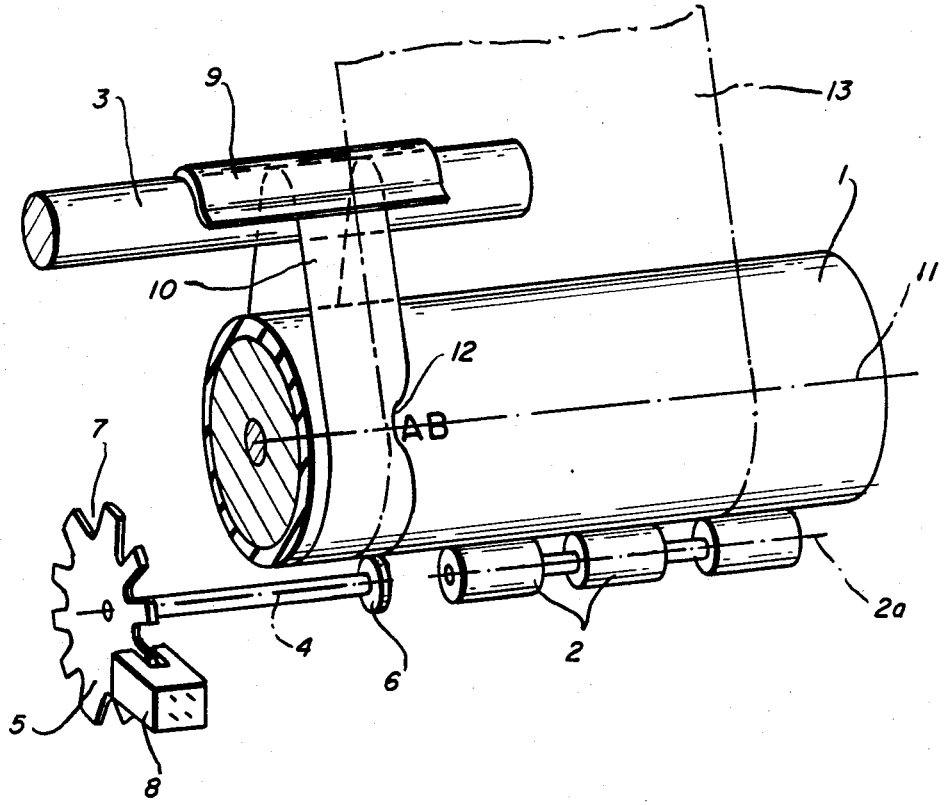
3
9
13
1
10
11
12
AB
7
2a
4
6
2
5
8

DEVICE FOR MONITORING PAPER IN TYPEWRITERS AND SIMILAR MACHINES

The invention relates to a device for monitoring paper feed movement in typewriters and similar machines wherein paper sheets inserted between a rotatable platen and pressure rollers are driven incident to platen rotation; more particularly it relates to a device for monitoring paper feed movement having a signal generator which is driven by paper movement incident to platen rotation.

BACKGROUND OF THE INVENTION

German Pat. No. 637,124 shows a mechanical device for blocking carriage movement when the machine is out of paper. To this end a two-arm lever is used. One arm is moved when the paper is introduced causing the other arm to swing out from blocking relation from the carriage so that it can move freely. When the paper is at the end, the second arm swings back into blocking relation with the carriage. In this device the paper edge which must operate the lever can be easily damaged. Besides, this device cannot recognize a failure of the paper to move.

German Pat. No. 2,258,546, corresponding to U.S. Pat. No. 3,949,856, discloses a device for monitoring feed movement of endless paper webs adapted to be driven by pins engageable with holes in the margin. Two rotating parts are used to generate reference signals which are compared with each other. When the comparison exceeds or drops below a certain limit value, the machine shuts itself off. This device is elaborate and expensive, as it requires two pulse generators.

Swiss Pat. No. 568,226 discloses a pulse generator driven by paper movement. This device is only suitable for monitoring long material webs, but not for individual paper sheets.

In accordance with the invention a pulse generator generates pulse sequences only in response to rotation of a drive roll by paper advanced by a line indexable platen. If there is no paper inserted or if paper does not move incident to platen indexing movement, no pulse sequences occur at the output of the pulse generator and this condition stops the machine.

An object of the invention is to provide a low-cost device for monitoring paper feed movement of endless and individual papers and which can also recognize whether the paper is in the printing range at all.

Another object of the invention is in the provision of a simple, easily-implemented paper monitoring device which is designed to avoid paper damage.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

The single FIGURE of the drawing is a perspective view of the elements of the invention associated with an indexable platen.

Referring now to the drawing there is shown a conventional platen 1 with associated pressure rollers 2 between which paper is inserted for line advance when the platen is indexed as by a motor. The platen, pressure rollers and a retaining bar 3 are mounted in a machine frame (not shown). Likewise mounted in the machine frame is a shaft 4 associated with a pulse generator comprising a driven disc 5. Shaft 4 is connected to be driven by a drive roll 6. Shaft 4 is so arranged that it extends coaxially to shaft 2*a* mounting pressure rollers 2. Disc 5 has in the embodiment shown notches 7 about its periphery whereby pulses will be generated when the disc 7 turns by means of a light and a light sensor in a mounting 8 embracing the periphery of the disc 7.

A stationary means in the form of a narrow belt 10 trained about the platen adjacent one end, preferably its left end, and the retaining bar 3 is secured by means of clamp 9 to the retaining bar 3. The clamp 9 assures that belt 10 cannot turn and belt 10 is sized to slip relative to platen when platen 1 is rotatably indexed. Belt 10 therefore does not impede the rotation of platen 1. Belt 10 can consist, e.g. of a thin plastic. At the level of printing line 11, belt 10 has a notch 12. Paper 13 to be printed on (endless or single sheet) is introduced into the machine such that its left edge comes to lie between belt 10 and drive roll 6.

When there is no paper in the typewriter or printer, drive roll 6 of the pulse generator 5 bears directly on stationary belt 10. Thus with no paper inserted, when platen 1 is turned, platen rotation is not transmitted to drive roll 6. Consequently no pulses are generated by the pulse generator. The typewriter or printer will therefore not work.

When paper 13 is introduced between the platen and pressure rollers its left edge is interposed between belt 10 and drive roll 6. Due to the pressure exerted by pressure rollers 2 on the paper 13 it will be advanced when platen 1 turns. This paper feed has the effect that drive roll 6 is turned by paper movement and a pulse is generated when the disc 7 turns by the light sensor in mounting 8. In this way certain pulse sequences incident to paper advances by the platen are generated by the pulse generator comprising disc 7 and the light sensor in mounting 8. These pulse sequences are gated as described, for example, in Swiss Pat. No. 568,226. If no pulses are generated over a predetermined time, the machine or the printer shuts itself off automatically.

The introduction of paper 13 presents no problems since shaft 4 of drive roll 6 is coaxial with shaft 2*a* supporting the pressure rollers 2 and drive roll 6, which has the same diameter as pressure rollers 2, performs in effect like a pressure roller 2 during paper insertion.

As soon as the bottom edge of paper 13 has moved out of the range between belt 10 and drive roll 6, the drive roll can no longer turn with the result that no pulses will be generated. This event is recognized by the machine as a shut-off criterion. Whenever drive roll 6 is no longer turned, either due to trouble (paperbackup, end of paper, damage in the drive of platen 1, etc.), the machine is shut off, so that the loss of information is reduced to a minimum, if there is any at all.

Notch 12 on the inner edge of belt 10 makes it possible that the start of printing line 11 can still be extended to the left edge of the paper overlying the belt 10 without causing different printing qualities due to its thickness.

The device is suitable for all types of known printers, such as matrix printers, typewheel printers, type shaft typewriters etc., but it can also be used in other paper-feeding machines, like photocopiers. Instead of a light barrier arrangement 8 a Hall generator, which is influenced by permanent magnets on the disc can be used.

The invention claimed is:

1. Paper feed monitoring apparatus for a printer or the like having a frame comprising a rotatable platen and associated pressure rollers adapted to line feed paper inserted between said platen and pressure rollers incident to platen indexing, a pulse generator having a drive roll positioned adjacent said platen to be contacted and driven by paper supported by said platen as said paper is fed by indexing of said platen, and means stationary relative to said printer frame located adjacent one end of said platen, positioned between said platen and paper carried by said platen, and aligned with said pulse generator drive roll, said means presenting a stationary surface at all times so that said drive roll is not rotated in the absence of paper being carried by said platen regardless of any movement of said platen.

2. Paper feed monitoring apparatus as recited in claim 1, said stationary means comprising a narrow belt positioned around the platen, and means for clamping said belt to said frame to prevent its movement incident to platen indexing.

3. Paper feed monitoring apparatus as recited in claim 2, said clamping means including a frame supported bar parallel to said platen about which said belt is trained, and a clamp mounted on said bar over said belt to hold the belt stationary.

4. Paper feed monitoring apparatus as recited in claim 2, said belt having a notch opposite the writing line to allow printing to the edge of paper.

5. Paper feed monitoring apparatus as recited in claim 1, said drive roll axis being coaxial with said pressure roller axis.

* * * * *